US006092717A

United States Patent [19]

Lowry

[11] Patent Number: 6,092,717

[45] Date of Patent: Jul. 25, 2000

[54] TUBULAR CONTAINER WITH INDEPENDENTLY OPENABLE COMPARTMENTS

[75] Inventor: James W. Lowry, Florence, S.C.

[73] Assignee: Sonoco Development Inc., Hartsville, S.C.

[21] Appl. No.: 09/175,816

[22] Filed: Oct. 20, 1998

[51] Int. Cl.[7] ..... B65D 25/04

[52] U.S. Cl. ..... 229/120.03; 229/120.32; 229/121; 229/5.84

[58] Field of Search ..... 229/120.32, 121, 229/5.84, 120.03

[56] References Cited

U.S. PATENT DOCUMENTS

| | | | |
|---|---|---|---|
| 1,292,935 | 1/1919 | Walsh | 220/504 |
| 1,634,569 | 7/1927 | Bray . | |
| 1,793,526 | 2/1931 | Stern . | |
| 3,071,281 | 1/1963 | Sawai . | |
| 3,144,152 | 8/1964 | Kopp . | |
| 3,317,087 | 5/1967 | Landis . | |
| 3,485,416 | 12/1969 | Fohrman . | |
| 3,885,672 | 5/1975 | Westenrieder . | |
| 4,011,347 | 3/1977 | Griffith . | |
| 4,042,156 | 8/1977 | Knight . | |
| 4,078,686 | 3/1978 | Karesh . | |
| 4,114,784 | 9/1978 | Hough et al. | 229/120.32 |
| 4,282,984 | 8/1981 | Curry, Jr. . | |
| 4,444,324 | 4/1984 | Grenell . | |
| 4,930,636 | 6/1990 | Meadows . | |
| 5,499,738 | 3/1996 | Burleigh . | |
| 5,511,666 | 4/1996 | Grip . | |
| 5,950,913 | 9/1999 | Rea et al. | 220/504 |

FOREIGN PATENT DOCUMENTS

| | | | |
|---|---|---|---|
| 0 857 568 A2 | 8/1988 | European Pat. Off. . | |
| 404031237 | 2/1992 | Japan | 220/504 |
| 2127376 | 4/1984 | United Kingdom | 220/504 |
| 2204554 | 11/1988 | United Kingdom | 220/504 |
| 2282895 | 3/1995 | United Kingdom . | |

*Primary Examiner*—Joseph M. Moy
*Attorney, Agent, or Firm*—Alston & Bird LLP

[57] ABSTRACT

A tubular container includes a tubular body open at both ends and a divider affixed within the body so as to divide the body into two tubular compartments each accessible through one of the open ends of the body. Each open end is closed by a closure. The body includes a polymer liner to which the divider is attached. The polymer liner and the divider preferably comprise heat-sealable materials and the divider is heat-sealed to the liner.

4 Claims, 2 Drawing Sheets

TUBULAR CONTAINER WITH INDEPENDENTLY OPENABLE COMPARTMENTS

FIELD OF THE INVENTION

The present invention relates to tubular containers for food products such as snack foods and the like.

BACKGROUND OF THE INVENTION

A variety of snack foods such as chips and the like are commercially sold in tubular composite containers. The containers typically are formed of paperboard spirally formed into a tube, and usually have an inner liner which acts as a barrier to gases and/or moisture, and an exterior label on which indicia and/or graphics are printed. The top opening of the container typically has a removable and recloseable closure which can be removed to access product and then reclosed to keep any unconsumed product fresh.

One such container which is commonly used for packaging chips produced in a stackable form is relatively small in diameter such that a single stack of chips in the container is closely surrounded by the interior surface of the container in order to keep the stack of chips from toppling over. Because of the small opening, many consumers find it difficult or impossible to reach an entire hand into the container, but instead must access product by inserting only their fingers into the container. A further hindrance to the removal of product, however, is that the container typically is relatively tall in relation to its diameter. Consequently, most consumers' fingers are not long enough to reach product located near the bottom of the container. A frequent consumer solution to this problem is to invert the container and dump product out the open end. However, this can be messy when there are small fragments of broken chips or the like in the container.

Making the container larger in diameter is an unsatisfactory solution to the problem, because the chips must be maintained in stacked orientation to minimize breakage and to make most efficient use of the space. Furthermore, making the container shorter is an unsatisfactory solution in those cases where consumers prefer a relatively larger-capacity container.

SUMMARY OF THE INVENTION

The present invention enables the packaging of snack foods such as chips and the like in tall, narrow tubular containers while improving accessibility of the product. To this end, the invention in one preferred embodiment thereof comprises a tubular composite body formed of a body wall, a liner covering the inner surface of the body wall, and a label covering the outer surface of the body wall. A divider is disposed partway along the length of the body and affixed to the liner, the divider partitioning the body into two tubular compartments each accessible through one of the open ends of the body. The container further includes a pair of end closures applied to the open ends of the body and which are removable for accessing product. Preferably but not necessarily, the closures are recloseable for maintaining freshness of any product which is not immediately consumed.

Advantageously, the divider is positioned so that each of the two compartments is short enough to allow a consumer to reach fingers through one of the open ends and access product located near the divider. The invention thus eliminates the need to invert the container and dump contents out the open end, and the container can be made to hold the same amount of product as a conventional container with only slightly increased packaging cost.

The invention also affords other advantages over conventional containers. For instance, two different products, such as plain chips and barbecue-flavored chips, can be packaged in the same container and kept separate so that each retains its proper flavor and aroma. Furthermore, whether a single type or two types of products are packaged in the container, the invention enables product freshness to be prolonged by allowing the consumer to keep one compartment sealed until the product in the other compartment has been consumed.

To these ends, the divider preferably comprises a composite material having barrier properties, and is affixed to the liner of the container so as to substantially seal one compartment from the other. In one embodiment of the invention, the divider includes a polymer film which is substantially impervious to moisture and gases. Preferably, the divider comprises a paper layer laminated on each side with a layer of polymer film, such as LDPE, HDPE, or the like. The divider may be secured to the liner by gluing or hot-melt adhesive, or by heat sealing when both the liner and divider include heat-sealable films.

In accordance with another aspect of the invention, there is provided a tubular container comprising a body formed as a generally cylindrical tube open at both ends, each end opening being less than about 3.0 inches in diameter. A divider is affixed within the body partway along the length thereof, the divider partitioning the body into two tubular compartments each accessible through one of the end openings. The length of the body and location of the divider are selected such that each of the compartments has an axial height of about 3.5 to 6 inches. The container includes a pair of removable end closures applied to the ends of the body for sealingly closing the end openings.

The invention also encompasses methods of making a tubular composite container having a center divider. One preferred method embodiment of the invention comprises the steps of forming a tubular composite container body including a body wall and a polymer liner affixed to an inner surface of the body wall; forming a generally disk-shaped divider; positioning the divider within the body about midway along the length thereof and affixing the divider to the liner so as to partition the body into two tubular compartments; and applying a removable end closure to each open end of the body.

Advantageously, both the divider and the liner are formed to have an outer layer of heat-sealable polymer, and the divider is affixed to the liner by heat sealing the polymer layers together. In one preferred embodiment, the divider is formed by using a punch to push a disk-shaped blank through a flanging die such that a peripheral portion of the blank is folded inward by the die to form a circular flange around the edge of the divider. The flanging die preferably is positioned adjacent one of the open ends of the tubular body, and the step of positioning the divider in the body comprises using the punch to push the divider into the body. The punch preferably comprises one of a pair of cooperating tools for heat sealing the divider to the liner, the other tool surrounding the tubular body from the outside at the location of the divider.

The invention thus retains all of the advantages of the conventional tubular composite containers for snack foods, but also provides improved product accessibility, facilitates packaging two different types of products in the same container, and enables product freshness to be prolonged.

BRIEF DESCRIPTION OF THE DRAWINGS

The above and other objects, features, and advantages of the invention will become more apparent from the following description of certain preferred embodiments thereof, when taken in conjunction with the accompanying drawings, in which.

DETAILED DESCRIPTION OF THE DRAWINGS

The invention is now explained by reference to certain preferred embodiments thereof. It will be understood, however, that the invention is not limited to these embodiments, but may take a variety of forms within the scope of the appended claims.

Figure 1:
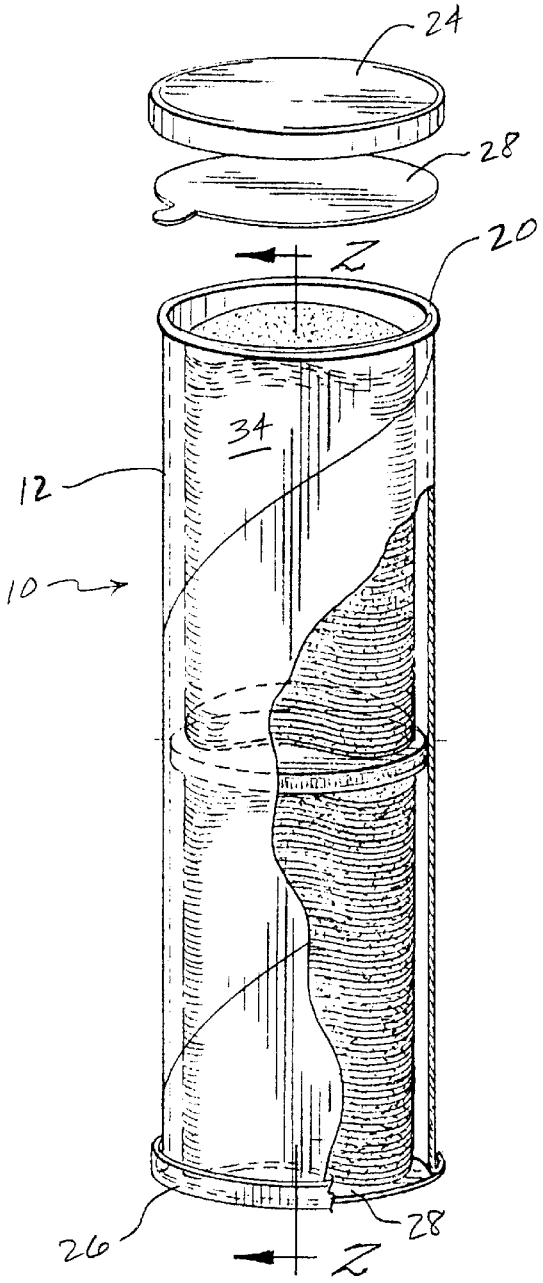
FIG. 1 is perspective view of a container in accordance with one preferred embodiment of the invention, partially broken away to show the divider and the container contents, and showing one of the closures in exploded view.
Figure 2:
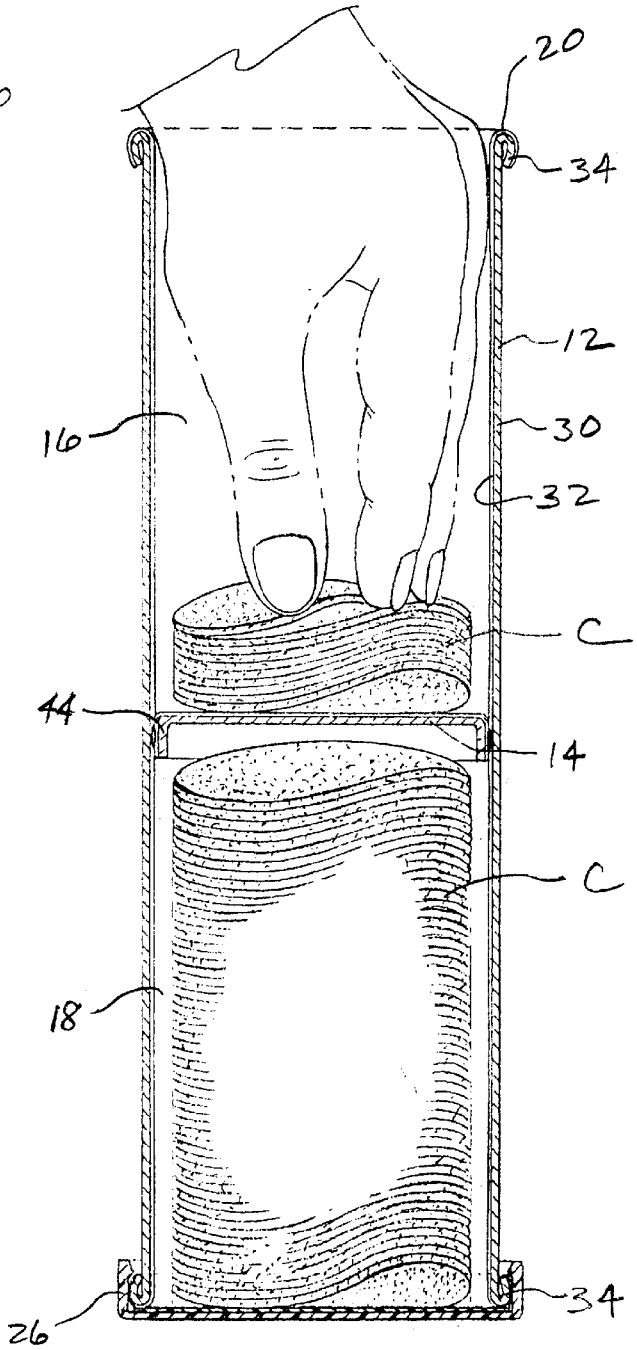
FIG. 2 is a cross-sectional view taken on line 2—2 of FIG. 1, also showing a consumer's fingers reaching into one compartment of the container to access product near the divider.

FIGS. 1–2 depict a container 10 in accordance with one preferred embodiment of the invention. The container 10 comprises a tubular body 12 within which a divider 14 is affixed so as to partition the body into two tubular compartments 16 and 18 on opposite sides of the divider. The compartments 16 and 18 are accessible through the corresponding open ends 20 and 22 of the body 12. The open ends 20 and 22 are closed by removable and recloseable closures 24 and 26, respectively. For originally sealing the open ends of the body 12 to protect the contents C of the container against the elements, each end also includes a removable flexible membrane 28 which is sealed onto the ends of the body 12 and covered by the closures 24 and 26. In known fashion, the membranes 28 are removable by the consumer upon initially opening each of the compartments 16 and 18, and are then discarded, the compartments being reclosed by replacing the closures 24 and 26.

The tubular body 12 may be formed in a variety of ways from a variety of materials. In a preferred embodiment as shown in the drawings, the body 12 is a composite body comprising a paperboard body wall 30, an inner liner 32 disposed against the inner surface of the body wall 30, and an outer label layer 34 attached to the outer surface of the body wall. The body wall 30 may be formed by spirally or convolutely wrapping a paperboard strip about an axis of the container to form the tubular body wall. Advantageously, the tubular body 12 is formed by spirally or convolutely wrapping a liner strip onto a mandrel (not shown), then spirally or convolutely wrapping a paperboard strip onto the liner on the mandrel with application of adhesive between the paperboard and the liner, and then spirally or convolutely wrapping a label strip onto the paperboard on the mandrel with application of adhesive between the paperboard and the label strip, in known manner. The liner 32 may be constructed of a variety of materials including foil, kraft paper, polymer film, metallized polymer film, and laminations of two or more of these materials. For example, the liner 32 may comprise what is known in the industry as a supported liner, which typically includes a relatively thick metal foil layer for improving the handling qualities of a liner strip during wrapping onto a mandrel, a layer of kraft paper bonded to one side of the foil for facilitating adhesion of the liner to the paperboard layer of a container, and a layer of polymer bonded to the other side of the foil. Alternatively, the liner 32 may comprise what is known as an unsupported liner characterized by the elimination of the foil and kraft paper layers. An unsupported liner may include one to a plurality of polymer layers, one or more surfaces of which may be metallized if desired.

The divider 14 may be constructed of a variety of materials and affixed within the body 12 in various ways. Preferably, the divider 14 is formed of a flexible material such as paper, paperboard, polymer film, metal foil, or laminations of two or more such materials. In accordance with a preferred embodiment of the invention as further described below in connection with FIGS. 3A–D, the divider 14 comprises a layer of paper 40 laminated on one or both sides with a layer of polymer film 45. This construction provides sufficient strength to prevent the divider 14 from tearing during normal handling and use of the container, and the polymer layer or layers impart a barrier function to the divider to prevent moisture and/or gases from passing through the divider.

The divider 14 may be secured within the body 12 by gluing or hot-melt adhesive, or by heat or induction sealing the divider to the liner 32. Preferably, the innermost layer of the liner 32 and the polymer film layer of the divider 14 are formed of heat-sealable materials such that the divider can be heat-sealed to the liner. This method of attaching the divider avoids the problem of applying an adhesive to the divider and/or liner without also getting the adhesive on other parts of the liner where it is not desired.

Figure 3A:
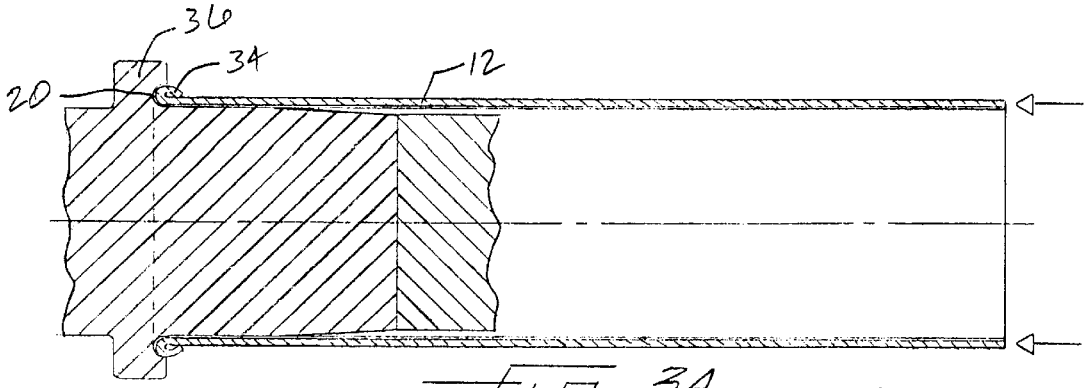
FIGS. 3A–D are a series of sectioned side elevational views showing steps of a process for making a container in accordance with the invention.

FIGS. 3A–D depict a sequence of manufacturing steps for making a container 10 in accordance with one preferred method embodiment of the invention. As shown in FIG. 3A, the tubular body 12 is first processed to form a curled lip or bead 34 at the open end 20 of the body. The body 12 is forced axially onto a curling die 36 which is configured to cause the end portion of the body 12 to be curled outwardly and rearwardly toward the opposite end 22 of the body. The resulting bead 34 will serve to engage the end closure 24, as further described below.

Figure 3B:
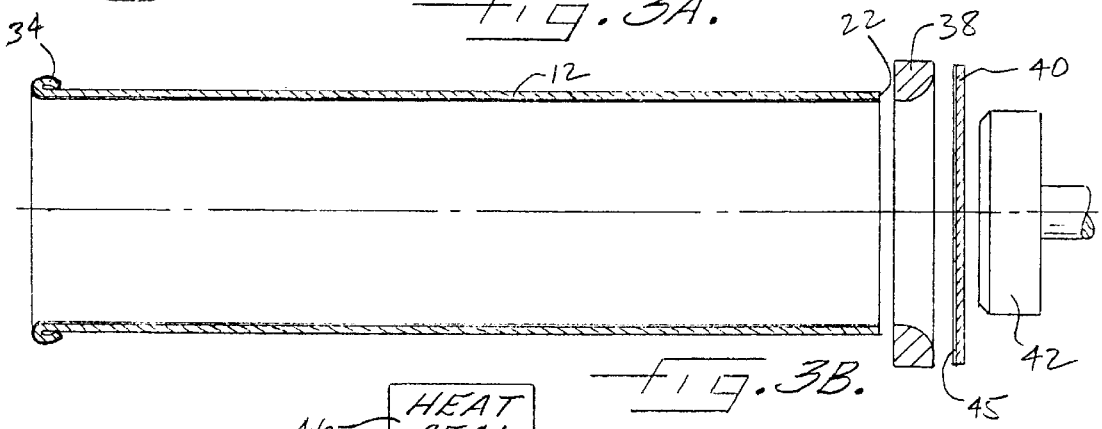

Next, as shown in FIG. 3B, the body 12 is positioned in axial alignment with a flanging die 38 adjacent the open end 22 of the body. A disk 40 of divider material having a diameter exceeding that of the body 12 is pushed by a punch 42 axially through the flanging die 38 and into the interior of the body 12. As the disk 40 is forced through the flanging die 38, the converging walls of the die 38 cause the peripheral portion of the disk 40 to be folded so as to form a generally circular flange 44 having an outer diameter about equal to the inner diameter of the body 12. If desired, the peripheral portion of the disk 40 can be notched prior to being pushed through the flanging die 38 so that there is little or no bunching or folding of the material onto itself when the flange is formed. Alternatively, the peripheral portion can be left unnotched, the flanging die forming the flange 44 by folding or pleating the disk material. This completes the formation of the divider 14.

Figure 3C:
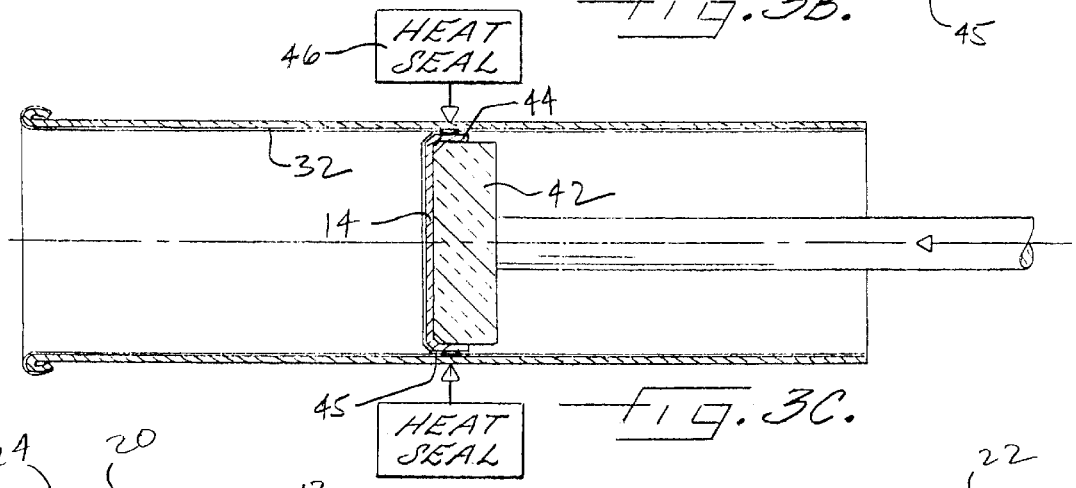

As depicted in FIG. 3C, the punch 42 is pushed into the body 12 until the divider 14 has reached the desired axial position with respect to the opposite ends of the container. Preferably, and as illustrated in the drawings, the divider 14 is moved to the axial midpoint of the body 12 so that it divides the body into two compartments of equal length. However, it will be appreciated that the divider 14 can be placed at any desired position in the body. Once the divider 14 is in the desired position, a heat-sealing operation 46 is performed to heat and compress the body 12 and the flange 44 of the divider together such that the heat-sealable polymer film layer 45 of the flange 44 is heat-sealed to the heat-sealable inner film layer of the liner 32.

Figure 3D:
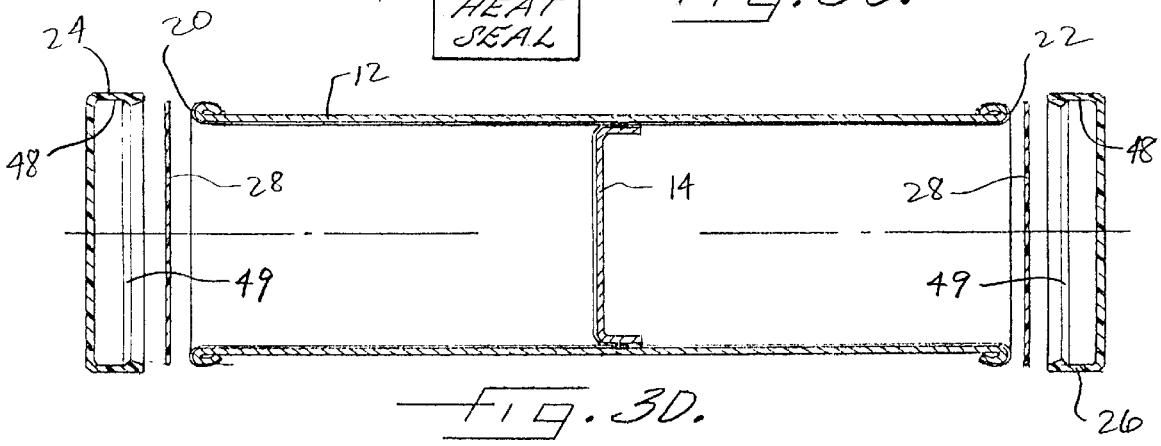

As shown in FIG. 3D, a curled bead 34 is formed on the end 22 of the body 12 in the manner shown in FIG. 3A. The body 12 is then ready to be filled with product. Once the compartments 16 and 18 have been filled, a membrane 28 is adhesively attached to each of the open ends 20 and 22 to seal the compartments. Finally, an overcap or closure 24 is applied to the end 20 and a closure 26 is applied to the end 22 to complete the assembly. Each of the closures has an inner surface 48 that defines a channel 49 or the like which engages the corresponding bead 34 on the body for retaining the closures in place.

The invention facilitates access to the contents C by reducing the axial length of the body 12 into which a consumer's fingers must extend in order to reach the contents. Commonly used containers of the type described herein typically have a diameter of about 3.0 inches or less, such that most people cannot reach an entire hand into the container but rather must use primarily the fingers to reach the contents of the container. Additionally, the height of a typical container may be from about 7 inches to about 12 inches, which is too tall for most consumers to be able to reach product near the bottom of the container with the fingers alone. However, as shown in FIG. 2, even when the compartment 16 is almost empty, the fingers of a hand can still access product near the divider 14. Once the compartment 16 is empty, the consumer may simply replace the cap 24 on the one open end 20, turn the container 10 upside down, and remove the cap 26 (and the membrane 28 if the compartment 18 has not previously been opened) to access product in the other compartment 18.

The invention also facilitates packaging two different types of product in the same container where it is desirable that the two products be kept separate. For example, plain potato chips may be kept in the compartment 16 while barbecue-flavored potato chips are kept in the other compartment 18. Advantageously, the divider 14 includes at least one layer that serves as a barrier to moisture and/or gases, such as the polymer film layers previously described, which aid in preventing flavors and aromas from one compartment from infiltrating into the other compartment.

Additionally, the invention facilitates keeping food products fresh for a longer period of time. Thus, a consumer may open only one of the compartments until the contents have been fully consumed. Meanwhile, the contents of the other compartment are still sealed so that they remain fresh.

From the foregoing description of preferred embodiments of the invention, it will be appreciated that the invention provides a unique compartmented tubular container and method of making such a container. While the preferred embodiments have been described in considerable detail, the invention is not limited to the embodiments that have been illustrated and described. Persons of ordinary skill in the art will readily comprehend various modifications and substitutions of equivalents that can be made to the described embodiments without departing from the scope of the invention as set forth in the appended claims. For example, while the body 12 has been described as being a composite body formed of paperboard, liner, and label materials, various other body constructions using different materials are possible. These and other modifications and substitutions of equivalents are intended to be encompassed within the scope of the claims.

What is claimed is:

1. A tubular composite container for food products, comprising:

a tubular composite body having a body wall which defines inner and outer surfaces and comprising at least one paperboard strip wrapped about an axis of the container to form a paperboard tube, a liner covering the inner surface of the body wall and comprising a layer of polymer film which forms an inner surface of the container, and an exterior label layer covering the outer surface of the body wall, the body defining two opposite end openings;

a divider disposed within the body partway along the length thereof and affixed to the liner and comprising a generally circular disk of composite material which is folded along the peripheral edge of the disk to form a cylindrical flange depending from the disk, the flange being attached to the liner of the body, the divider partitioning the body into two tubular compartments each accessible through one of the end openings; and a pair of removable and replaceable end closures applied to opposite ends of the body for sealingly closing the end openings.

2. The composite container of claim 1, wherein the composite material of the disk comprises a paper/polymer film laminate layers and the polymer film layer of the flange is heat sealed to the polymer film layer of the liner.

3. The container of claim 1, wherein the divider is glued to the liner.

4. The container of claim 1, wherein the divider is affixed to the liner by hot-melt adhesive.

* * * * *